US009498016B2

(12) United States Patent
Tseng

(10) Patent No.: US 9,498,016 B2
(45) Date of Patent: Nov. 22, 2016

(54) LIGHTING SHOE

(71) Applicant: Shen-Ko Tseng, Taipei (TW)

(72) Inventor: Shen-Ko Tseng, Taipei (TW)

( * ) Notice: Subject to any disclaimer, the term of this patent is extended or adjusted under 35 U.S.C. 154(b) by 777 days.

(21) Appl. No.: 13/742,383

(22) Filed: Jan. 16, 2013

(65) Prior Publication Data

US 2013/0185961 A1 Jul. 25, 2013

(30) Foreign Application Priority Data

Jan. 16, 2012 (CN) ..... 2012 2 0017283 U

(51) Int. Cl.
*A43B 3/00* (2006.01)

(52) U.S. Cl.
CPC ..... *A43B 3/001* (2013.01); *A43B 3/0015* (2013.01); *A43B 3/0005* (2013.01)

(58) Field of Classification Search
CPC ... A43B 3/0005; A43B 3/001; A43B 3/0015
USPC ..... 36/163, 43
See application file for complete search history.

(56) References Cited

U.S. PATENT DOCUMENTS

2009/0193689 A1* 8/2009 Galica et al. ..... 36/137
2011/0308113 A1* 12/2011 Hartford et al. ..... 36/136

* cited by examiner

*Primary Examiner* — Stephen F Husar
*Assistant Examiner* — Danielle Allen

(57) ABSTRACT

A lighting shoe includes a power generating device. When a user steps on or presses the lighting shoe, the power generating device bears an external force and generates an inducted current or charge by electromagnetic induction or piezoelectric characteristic to supply the LED to light. To be suitable for the thickness, the electrical requirement, or the cost of the lighting shoe, various similar power generating devices are disclosed to match the shoes in the present invention. The lighting shoe of the invention can increase the identification rate in the night, and improve the traffic safety of the user.

15 Claims, 10 Drawing Sheets

LIGHTING SHOE

BACKGROUND OF THE INVENTION

1. Field of the Invention

This invention relates to a lighting shoe, and more particularly, to the lighting shoe which is capable of generating electric energy and emitting light by electromagnetic induction and piezoelectric unit.

2. Description of the Prior Art

Various products having practicability as well as energy saving function appear on marketplace with the trend of environment protection. The products generating electric energy by simple motions achieve the energy saving function and interest to usage. For example, the flash lights generating electric energy by hand pressing and the bicycles transforming mechanical energy to electric energy are practical products with electric energy generating ability.

On the other hand, the traffic accidents may happen easily on the pedestrian if he walks in the night or in a somber environment. Therefore, the pedestrian often needs to wear reflective or lighting accessory to increase the identification rate in the night. The lighting accessory containing thin battery can be carried by the pedestrian to increase the identification rate. However, the thin battery includes mercury and it may make environment pollution. Besides, the thin battery may have leakage, damp, or damage problems if the lighting accessory is not applied enough waterproof mechanism.

As described above, if the lighting accessory can generate electric energy by simple motions and the structure of the lighting accessory is simple enough to avoid high-specification waterproof mechanism, the mercury battery can be removed from the light accessory so that the light accessory can be worn all day to improve the traffic safety of the pedestrian. Therefore, the above-mentioned lighting accessory is highly practical and becomes an important research subject.

SUMMARY OF THE INVENTION

One object of the present invention is to provide a lighting shoe capable of generating electric energy by simple motions. The lighting shoe needs no mercury battery with high pollution and generates LED light source to improve the traffic safety of the pedestrian.

According to an embodiment of the invention, the lighting shoe includes a main body, a power generating device, and a lighting device. The main body has a heel part. The lighting device is coupled to the power generating device and has at least one LED unit, where the lighting device receives the electric energy from the power generating device and providing the electric energy to the LED unit to generate the light.

The power generating device is configured in the heel part for bearing an external force and generating electric energy according to the external force, and the power generating device includes a first casing, a second casing, a magnetic component, an induction coil, and a first piezoelectric module. The first casing has at least one first engagement part. The second casing has at least one second engagement part which is movably coupled to the first engagement part to form a space between the first casing and the second casing. The magnetic component is fixed on the first casing and configured in the space. The induction coil is fixed on the second casing and configured in the space, and it is positioned outside the contour of the magnetic component. The first piezoelectric module is configured between the induction coil and the second casing. When the external force acts on the power generating device, the first casing and the second casing move relatively to each other so that the induction coil generates an induced current by sensing a magnetic flux variation, and the first piezoelectric module generates a first charge by absorbing the pressure between the magnetic component and the second casing.

In practice, the power generating device in the lighting shoe of the invention further includes an elastic component and a third casing. The elastic component is configured between the first casing and the second casing. When the external force acts on the power generating device, the first casing and the second casing move relatively to each other and the elastic component provides a recovery force. The third casing contacts the first casing and has a third engagement part for engaging the first engagement part. When the external force acts on the power generating device, the second casing and the third casing move relatively to each other.

In addition, the lighting shoe of the invention further includes an electricity storing device coupled to the induction coil and the first piezoelectric module to receive the induced current and the first charge and generate a stored electric energy for the lighting device. It should be noted that the first piezoelectric module of the power generating device can be omitted but the induction coil can be reserved according to the practical requirement.

Another object of the present invention is to provide another lighting shoe. According to another embodiment, the main body, the lighting device, and the first casing, the second casing, the magnetic component and the induction coil of the power generating device of the lighting shoe are similar to those in the above paragraphs, so they would not be repeated here. The power generating device in this embodiment further includes a third casing and a second piezoelectric module. The third casing has a third engagement part for engaging the first engagement part. The second piezoelectric module is configured between the second casing and the third casing. When an external force acts on the power generating device, the first casing and the second casing move relatively to each other so that the induction coil generates an induced current by sensing a magnetic flux variation, and the second piezoelectric module generates a second charge by absorbing the pressure between the second casing and the third casing.

In practice, the power generating device of the lighting shoe further includes a first piezoelectric module and an elastic component. The first piezoelectric module is configured between the magnetic component and the second casing. When the external force acts on the power generating device, the first casing and the second casing move relatively to each other and the first piezoelectric module generates a first charge by absorbing the pressure between the magnetic component and the second casing. The elastic component can be configured between the first casing and the second casing or between the second casing and the third casing. When the elastic component is configured between the first casing and the second casing and the external force acts on the power generating device, the first casing and the second casing move relatively to each other, and the elastic component provides a recovery force. When the elastic component is configured between the second casing and the third casing and the external force acts on the power generating device, the second casing and the third casing move relatively to each other, and the elastic component provides a recovery force.

In practice, the lighting shoe of the invention further includes an electricity storing device. The difference between the above embodiment and this embodiment is that the electricity storing device of this embodiment is coupled to the first piezoelectric module, the second piezoelectric module, and the induction coil to receive the first charge, the second charge, and the induced current and to generate a stored electric energy accordingly for the lighting device or other coupled device and component.

It should be noted that the first piezoelectric module and the second piezoelectric module can include an elastic object and a piezoelectric unit set. The elastic object has a first elastic coefficient. The piezoelectric unit set generates a first charge and the second charge corresponding to the first piezoelectric module and the second piezoelectric module. The piezoelectric unit set is configured in the elastic object and formed by a plurality of piezoelectric units stacked and series connected to each other. It should be noted that the amount of piezoelectric units are not limited, but decided according to the practical requirement. Each of the piezoelectric units has a second elastic coefficient and includes a piezoelectric material and a metal plate, wherein the second elastic coefficient is larger than the first elastic coefficient. In practice, the first piezoelectric module or the second piezoelectric module of the power generating device can be omitted but the induction coil can be reserved according to the practical requirement.

As described above, the lighting shoe of the invention includes the power generating device. When a user steps on or presses the power generating device, it generates and stores an inducted current by electromagnetic induction to supply the LED to light. To be suitable for the thickness, the electrical requirement, or the cost of the lighting shoe, various similar power generating devices are disclosed to match the shoes. The lighting shoe of the invention can increase the identification rate in the night, and improve the traffic safety of the user.

On the advantages and the spirit of the invention, it can be understood further by the following invention descriptions and attached drawings.

BRIEF DESCRIPTION OF THE APPENDED DRAWINGS

DETAILED DESCRIPTION OF THE INVENTION

Figure 1:
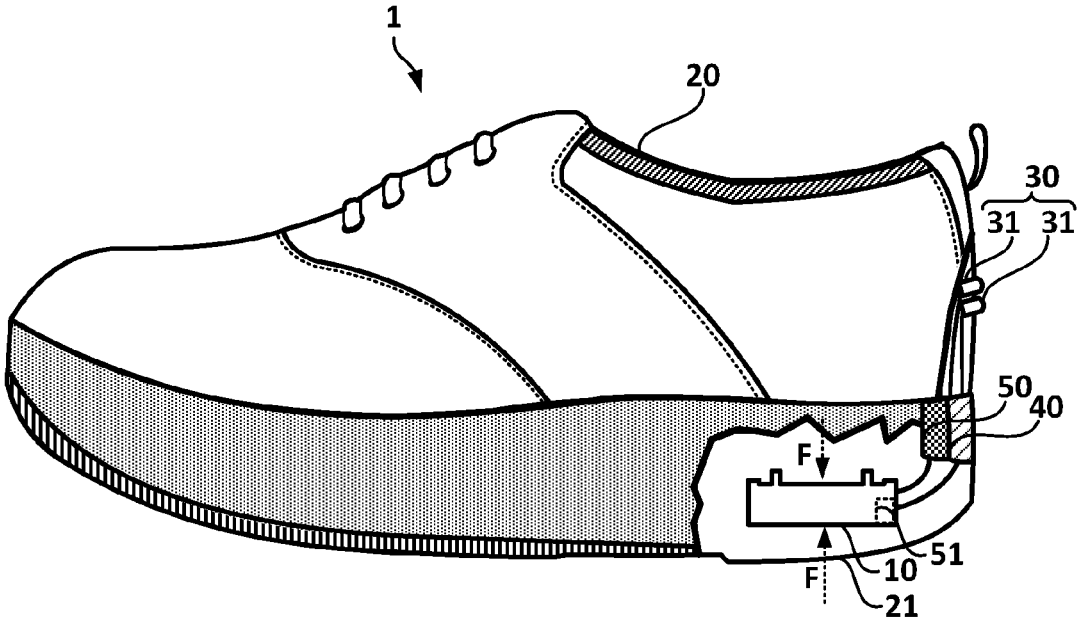
FIG. 1 is a schematic drawing illustrating a lighting shoe according to an embodiment of the invention.

The present invention discloses a lighting shoe. Please refer to FIG. 1. FIG. 1 is a schematic drawing illustrating a lighting shoe according to an embodiment of the invention. As shown in FIG. 1, the lighting shoe 1 includes a power generating device 10, a main body 20, a lighting device 30, and an electricity storing device 50.

As shown in the figures, the main body has a heel part 21 for bearing an external force F from the user's heel to the lighting shoe 1. The power generating device 10 is configured in the heel part 21 for bearing the external force F and generating electric energy according to the external force F. The external force F is the gravity force or the action force on the heel part 21 by the user's weight. The heel part 21 is defined as the part of the main body 20 between the ground and the user's foot. In this embodiment, the power generating device 10 is configured in the rear area of the heel part 21 and corresponding to the user's heel, however, it is not a limitation.

The power generating device 10 is configured in the heel part 21 for bearing the external force F and generating electric energy according to the external force F. In detail, the power generating device 10 generating an electric energy corresponding to the external force F acting on the heel part 21 of the main body 20 by the user.

The lighting device 30 is coupled to the power generating device 10 and has at least one LED unit 31. The lighting device receives the electric energy from the power generating device and provides the electric energy to the LED unit 31 to generate the light. The lighting device 30 can be configured in any position of the main body 20. In this embodiment, two LED units 31 of the lighting device 30 are configured at the back of the lighting shoe 1 respectively to remind the pedestrians or drivers behind, however, it is not a limitation for the positions of the LED units. The configured positions of the LED units are according to the designer's or user's requirements. For example, the LED units 31 can be configured at the top, front, or side of the main body 20. In this embodiment, the lighting device 30 includes the plurality of the LED units 31 arranged in a 2D matrix, but it is not a limitation either.

The lighting shoe 1 includes a control device 40 in this embodiment. However, the control device 40 consumes the power too, and it can be omitted from the lighting shoe 1 unless the lighting device 30 has to emit the light with specific pattern.

The control device 40 can be coupled to the power generating device 10, the electricity storing device 50, and the lighting device 30 for controlling the lighting device 30 to emit light and controlling the frequency, color, or pattern of the light. In the embodiment, the control device 40 includes a printing circuit board and the operational circuit configured in the printing circuit board. The control device 40 receives the electric power from the power generating device 10 or the electricity storing device 50. If the control device 40 is omitted, the power generating device 10 can be coupled to the lighting device 30 for providing the electric power to the lighting device 30.

The electricity storing device 50 is coupled to the power generating device 10 and the lighting device 30 for receiving the electric power from the power generating device 10 and storing the electric power as a stored electric energy, which is provided to the lighting device 30. In detail, the electricity storing device 50 is capable of rectifying or adjusting the charges or inducted currents generated by the power generating device to output a stable electric energy. In the embodiment, the electricity storing device 50 can be a rechargeable battery but it is not a limitation. For example, the electricity storing device 50 can be a capacitance or other component with electricity storing or current rectifying functions.

The power generating device 10 can be used as the LED light source with power generating function by stepping. By the user exerting the external force F on the shoe pads or ground pads at walking, the LED unit emits light so that the power generating device needs no additional battery and becomes a green product. It should be noted that the electricity storing device 50 or the control device 40 can be selectively omitted and the lighting device 30 can be coupled to the elements for generating electric power according to the cost, weight, or power consumption. If the electricity storing device 50 is omitted, the power generating devices 10 can be directly connected to the lighting device 30 or connected to the lighting device 30 through a rectification component 51, which is capable of rectifying or adjusting the charges or inducted currents to output a stable electric energy.

Figure 2A:
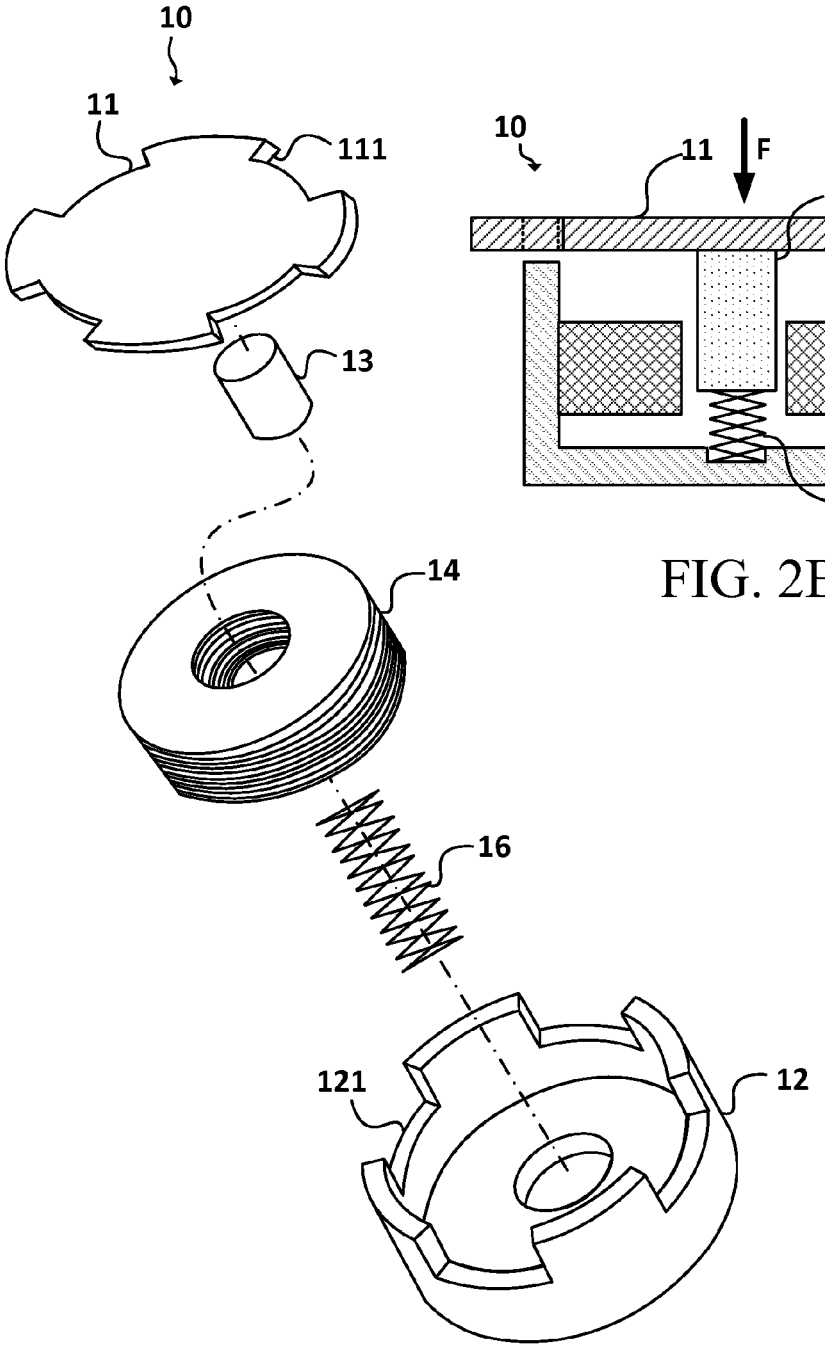
FIG. 2A is an explosion drawing illustrating a power generating device according to an embodiment of the invention.
Figure 2B:
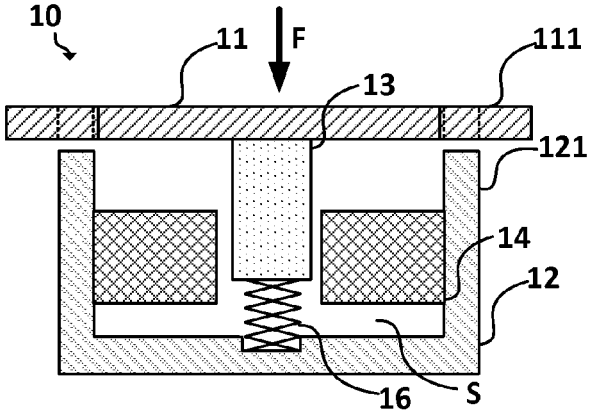
FIG. 2B is a sectional diagram illustrating a power generating device according to the embodiment of the invention.

To be suitable for the thickness, the electrical requirement, or the cost of the lighting shoe, various similar power generating devices are disclosed to match the shoes. In other words, the power generating device 10 can be various types in the present invention, and the followings are embodiments of the power generating device 10. Please refer to FIG. 2A and FIG. 2B. FIG. 2A and FIG. 2B are an explosion drawing and a sectional diagram illustrating a power generating device according to an embodiment of the invention. The power generating device 10 includes a first casing 11, a second casing 12, a magnetic component 13, an induction coil 14, and an elastic component 16.

The first casing 11 has at least one first engagement part 111. In practice, the first engagement part 111 can be integrally fixed on the first casing 11. The shape of the first casing 111 can be other suitable shapes but not limited to the fan-shaped one shown in the figures.

The second casing 12 has at least one second engagement part 121 corresponding to and capable of being movably coupled to the first engagement part 111, so as to make the first casing 11 and the second casing 12 closed to form a space S for configuring the magnetic component 13 and the induction coil 14 therein.

In this embodiment, the first casing 11 can be a cover and the second casing 12 can be a bowl structure, and the first engagement part 111 and the second engagement part 121 can be used for guiding the directions of the relative motions of the first casing 11 and the second casing 12. In detail, the first engagement part 111 and the second first engagement part 121 can be groove, sliding rail, or other suitable structure to enable the first casing 11 and the second casing 12 to move relatively to each other. The magnetic component 13 is fixed on the first casing 11. In practice, the magnetic component 13 can be fixed on the surface of the first casing 11 and configured in the space S. The material of the magnetic component 13 is not limited to this embodiment. For example, the magnetic component 13 can be made of neodymium magnet or other suitable component which provides magnetic force.

The induction coil 14 is fixed on the second casing 12 and configured in the space S, and it is positioned outside the contour of the magnetic component 13. When an external force F acts on the power generating device 10 or the first casing 11 and the second casing 12 thereof, the first engagement part 111 and the second engagement part 121 move relatively to each other, so that the induction coil 14 generates an induced current by sensing a magnetic flux variation of the magnetic component 13. It should be noted that the external force F is not limited to act on the first casing. For example, the external force F can be exerted on the second casing 12 to move relatively to the fixed first casing 11.

In practice, the induction coil 14 is positioned outside the contour of the magnetic component 13, and the induction coil 14 generates the induced current by sensing the magnetic flux variation caused by the relative displacement when the magnetic component 13 and the induction coil 14 move relatively to each other by the external force F. The induction coil 14 is coupled to the electricity storing device 50 to send the induced current to the electricity storing device 50 to store it as the stored electric energy for lighting device 30. If the electricity storing device 50 is omitted from the lighting shoe 1, the induction coil 14 can be directly connected to the lighting device 30 or connected to the lighting device 30 through a rectification component (not shown in the figures) to provide the electric energy.

In the embodiment, the power generating device 10 further includes an elastic component 16 configured between the first casing 11 and the second casing 12. The elastic component 16 provides a recovery force to enable the first casing 11 and the second casing 12 back to the original positions when the first casing 11 and the second casing 12 move relatively to each other by the external force F acting on the power generating device 10. In detail, the elastic component 16 is configured at the position between the magnetic component 13 and the second casing 12 in the space S formed by the first casing 10 and the second casing 14 closing. When the external force F acts on power generating device 10, the first casing 11 and the second casing 12 move relatively to each other to cause a replacement, and the directions of the relative motion and the displacement of them are guided by the first engagement part 111 and the second engagement part 121. In this embodiment, the directions of the relative motion and the displacement of the first casing 11 and the second casing 12 are parallel to the external force F. The external force F capable of enabling the first casing 11 and the second casing 12 to move relatively to each other is included in the scope of the invention.

Before the external force F acts on the power generating device 10, the magnetic circuit formed by the magnetic component 13 and the induction coil 14 is not closed, and the magnetic flux is smaller. On the other hand, when the external force F acts on the power generating device 10, the magnetic circuit formed by the magnetic component 13 and the induction coil 14 is closed, and the magnetic flux is larger. The induction coil 14 senses the magnetic flux variation to generate inducted current and induction voltage. In practice, to provide larger magnetic flux variation, the elastic component 16 can be embedded in the second casing 12 to enable the magnetic component 13 and the second casing 12 contact to each other when the magnetic circuit is closed, as shown in FIG. 2B. However, it is not a limitation. The elastic component 16 has enough effect even though the elastic component 16 is not embedded in the second casing 12.

It should be noted that the elastic component 16 is just configured between the first casing 11 and the second casing 12 to provide the recovery force against the external force F in this embodiment, and one skilled in the art can arrange the elastic component 16 to any position in the space S. The elastic component 16 can be spring, elastic piece, or other elastic objects in practice. According to different design of the invention, the power generating device 10 may have enough effect even if the elastic component 16 is removed. In practice, the magnetic component 13 can recover to the original position by magnetic attraction after the magnetic component 13 is drawn out from or pushed into the induction coil 14 by the external force F. That is to say, the elastic component 16 is an auxiliary component but not an essential component.

Figure 3A:
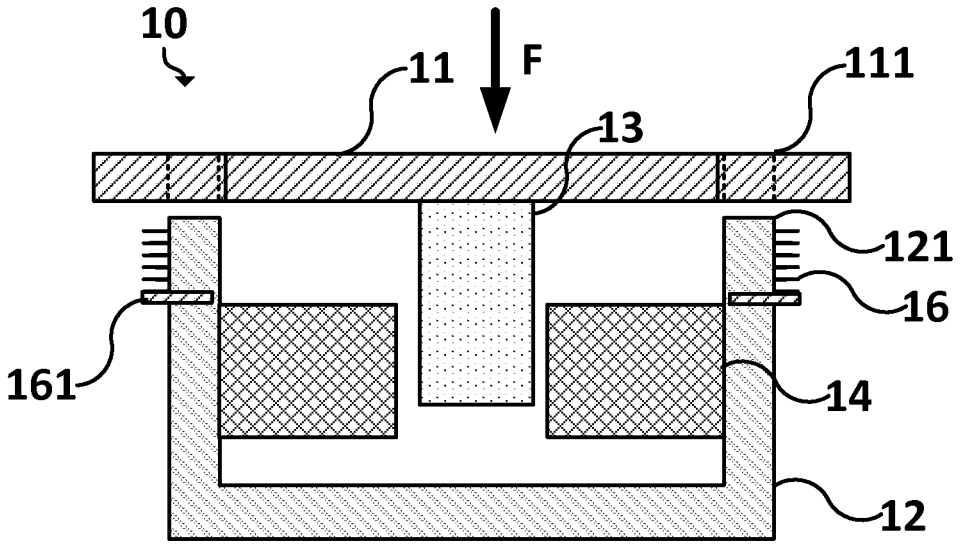
FIG. 3A is a sectional diagram illustrating a power generating device before the external force F acts according to another embodiment of the invention.
Figure 3B:
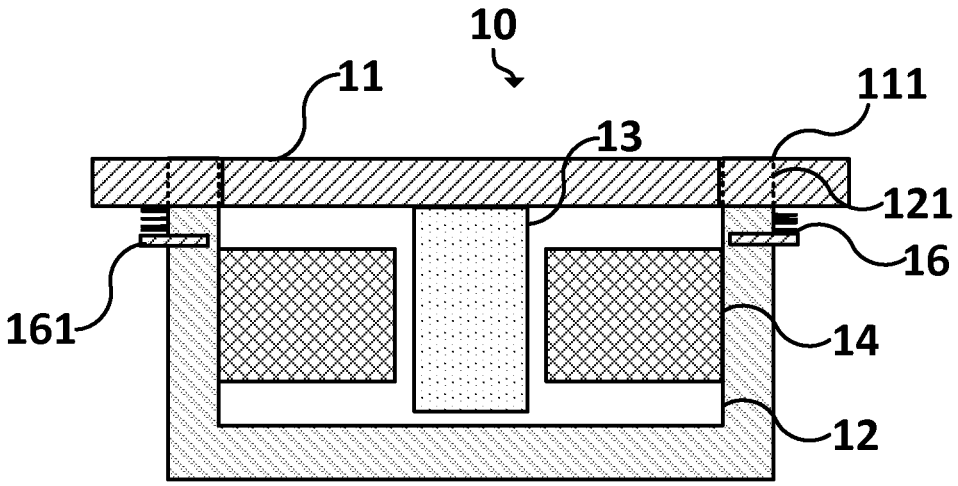
FIG. 3B is a sectional diagram illustrating a power generating device when the external force F acts according to the embodiment of the invention.

Please refer to FIG. 3A and FIG. 3B. FIG. 3A is a sectional diagram illustrating a power generating device before the external force F acts according to another embodiment of the invention. FIG. 3B is a sectional diagram illustrating a power generating device when the external force F acts according to the embodiment of the invention. As shown in the figures, the elastic component 16 is configured between the first engagement part 111 of the first casing 11 and the second engagement part 121 of the second casing 12 to provide the recovery force against the external force F in this embodiment. By coupled to or embedded in the outside wall or a fixing structure 161 of the inside wall of the second casing 12, the elastic component 16 can be held on the surface of the second casing 12 and provide a force opposite to the external force F to the first casing 11. The shape of the fixing structure is corresponding to the outside wall or the inside wall of the second casing 12. It should be noted that the embodiment shown in FIG. 3A and FIG. 3B is an extending design of the embodiment shown in FIG. 2A, so that the configurations of the corresponding elements in both embodiments are the same except that of the elastic component 16.

Figures 4A, 4B:
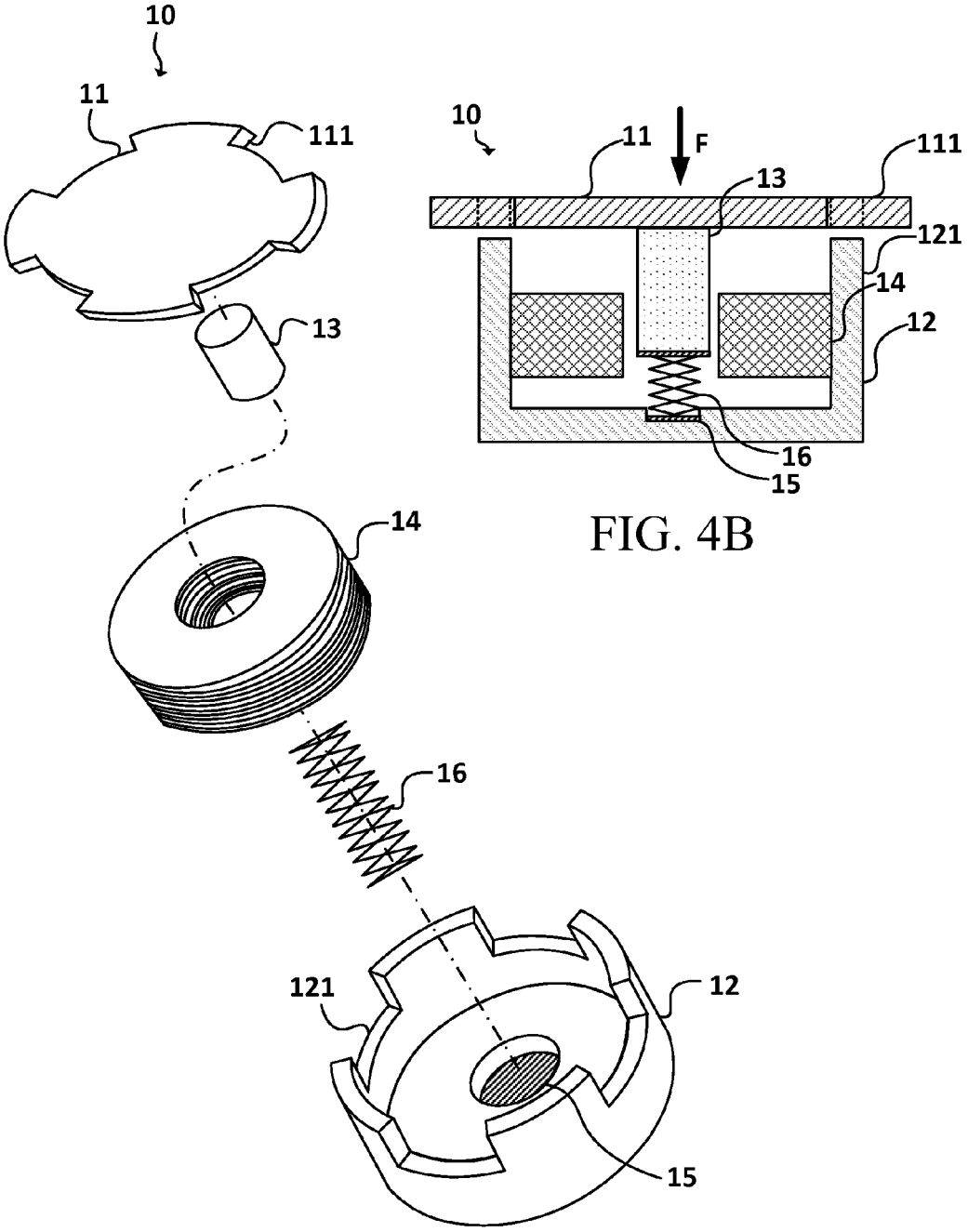
FIG. 4A is an explosion drawing illustrating a power generating device according to another embodiment of the invention.
FIG. 4B is a sectional diagram illustrating a power generating device according to the embodiment of the invention.

To further improve the effect of the power generating device 10, a first piezoelectric module 15 can be added into the power generating device shown in FIG. 2A and FIG. 2B. Please refer to FIG. 4A and FIG. 4B. FIG. 4A and FIG. 4B are an explosion drawing and a sectional diagram illustrating a power generating device according to another embodiment of the invention. The first piezoelectric module 15 is configured between the magnetic component 13 and the second casing 12 in the embodiment. In detail, the first piezoelectric module 15 can be configured between the magnetic component 13 and the surface corresponding to the magnetic component 13 of the second casing 12. When the surface of the magnetic component 13 contacts the second casing 12, the magnetic component 13 exerts a pressure on the second casing 12 to make a deformation of the first piezoelectric module 15, and the first piezoelectric module 15 generates a first charge by absorbing the pressure between the magnetic component 13 and the second casing 12. In detail, the first piezoelectric module 15 deforms so that a potential difference between the two opposite surfaces of the first piezoelectric module 15 is introduced to generate the first charge corresponding to the pressure when bearing the external force F. The first piezoelectric module 15 is coupled to the electricity storing device 50 to send the first charge to the electricity storing device 50 to store it as the stored electric energy for lighting device 30. If the electricity storing device 50 is omitted from the lighting shoe 1, the first piezoelectric module 15 can be directly connected to the lighting device 30 or connected to the lighting device 30 through a rectification component (not shown in the figures) to provide the electric energy. It should be noted that the configurations of the elements in this embodiment are the same as those in the embodiments shown in FIG. 2A and FIG. 2B, except the configuration of the elastic component 16.

Figure 5A:
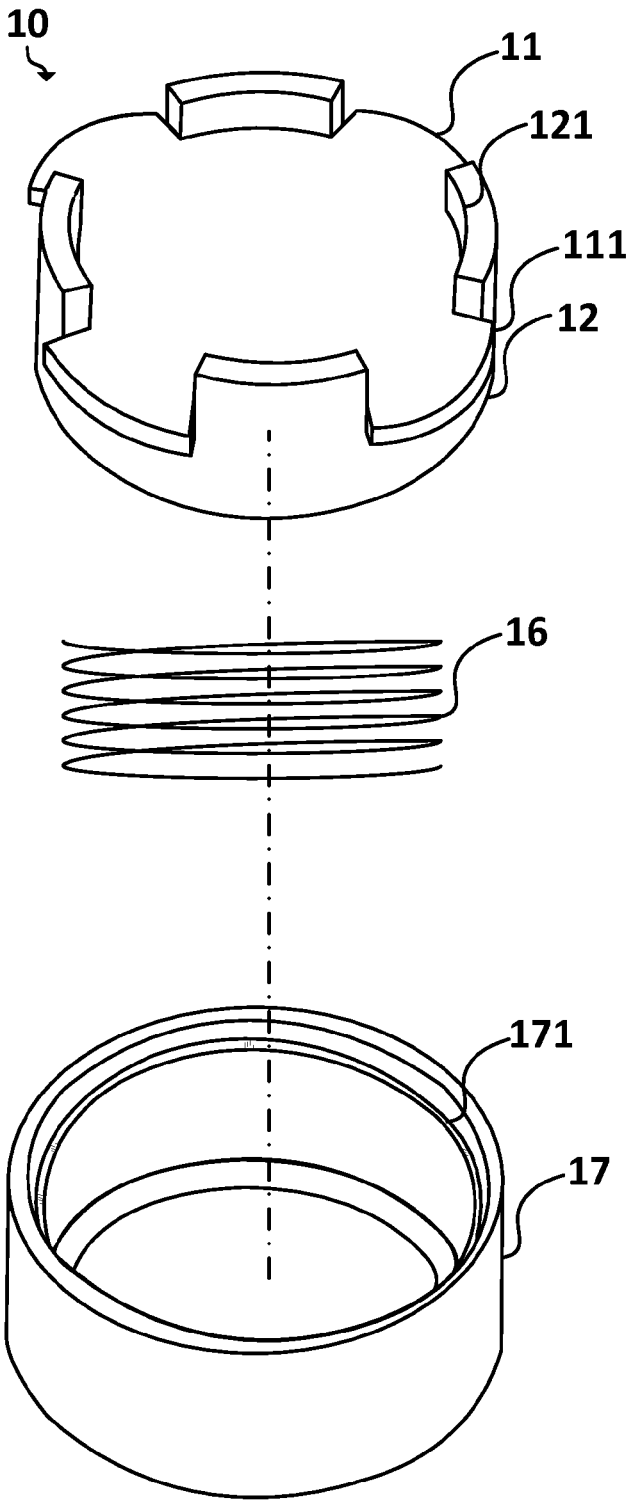
FIG. 5A is a schematic drawing illustrating a power generating device according to another embodiment of the invention.
Figure 5B:
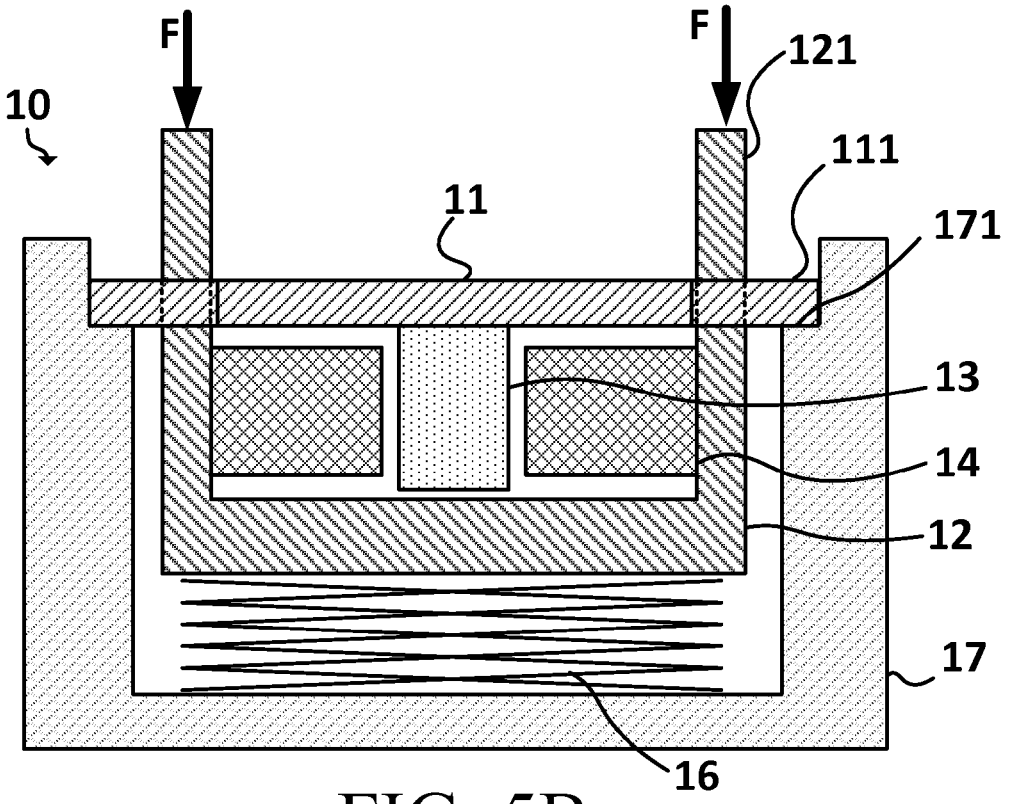
FIG. 5B is a sectional diagram illustrating a power generating device before the external force acts according to the embodiment of the invention.
Figure 5C:
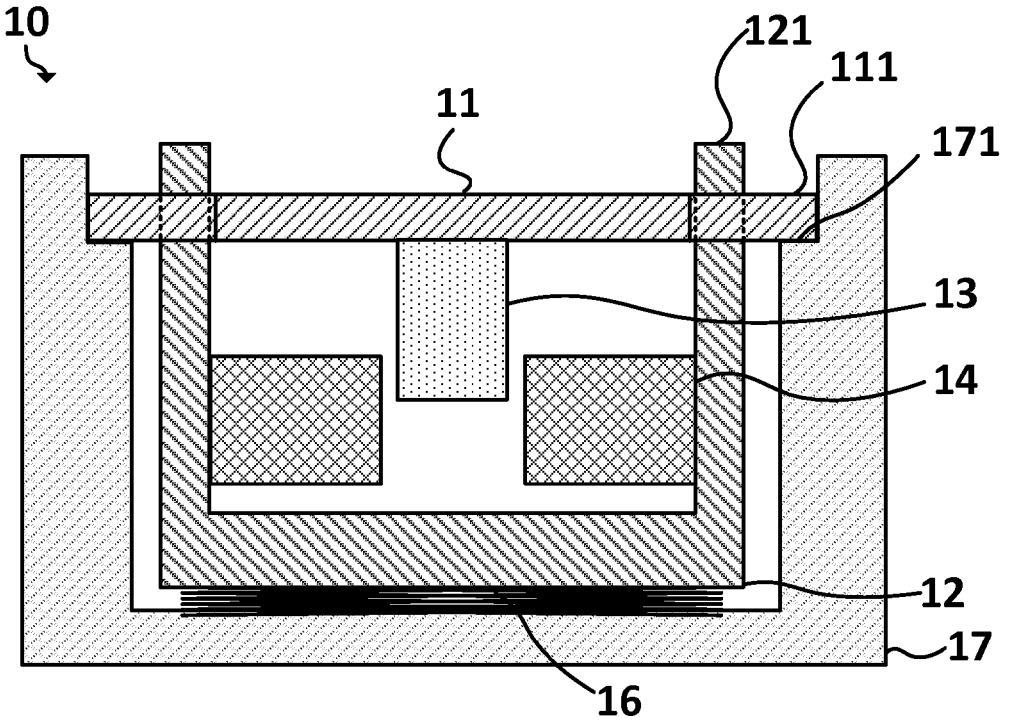
FIG. 5C is a sectional diagram illustrating a power generating device when the external force acts according to the embodiment of the invention.

In addition, another type of the power generating device is disclosed in the followings. Please refer to FIG. 5A to FIG. 5C. FIG. 5A to FIG. 5C are a schematic drawing, a sectional diagram before the external force acts, and a sectional diagram when the external force acts respectively illustrating a power generating device according to another embodiment of the invention. In this embodiment, the power generating device 10 includes a first casing 11, a second casing 12, a third casing 17, a magnetic component 13, an induction coil 14, and an elastic component 16.

The shapes and functions of the first casing 11, the second casing 12, the magnetic component 13 and the induction coil 14 are similar to those in the embodiment shown in FIG. 2A and FIG. 2B, so they would not be repeated here. The difference between this embodiment and the above-mentioned embodiments is that the power generating device 10 includes the third casing 17. The third casing 17 contacts the first casing 11 and has a third engagement part 171 for engaging or blocking the first engagement part 111. When the external force F acts on the second casing 12 or the third casing 17 of the power generating device 10, the third engagement part 171 engages the first engagement part 111 to prevent the third casing 17 and the first casing 11 from relative motion, so that the external force F can be applied for enabling the second casing 12 and the third casing 17 to move relatively to each other. In the embodiment, the third engagement part 171 is a convex ring fixed on the inside wall of the third casing 17 for blocking the first engagement part 111. The difference between this embodiment and the above-mentioned embodiments is that the elastic component 16 is configured between the second casing 12 and the third casing 17 and provides a recovery force against the external force F when the second casing 12 and the third casing 17 move relatively to each other. It should be noted that the elastic component 16 can be configured between the first casing 11 and the second casing 12 in the FIG. 2A to FIG. 4B by the user although it is not configured in the above-mentioned embodiments.

It should be noted that the external force F acts on the opening of the second casing 12 to push the second casing 12 to move toward the third casing 17. Therefore, the elastic component 16 is configured between the second casing 12 and the third casing 17 and provides a recovery force against the external force F. One skilled in the art can arrange the elastic component 16 to any position between the second casing 12 and the third casing 17. In practice, the elastic component 16 is not limited to this embodiment.

The embodiment shown in FIG. 5A and the FIG. 5B is similar to the embodiments shown in FIG. 2A to FIG. 4A, so that the extending designs in the above-mentioned embodiments of FIG. 2A to FIG. 4A can be used in this embodiment.

Figure 5D:
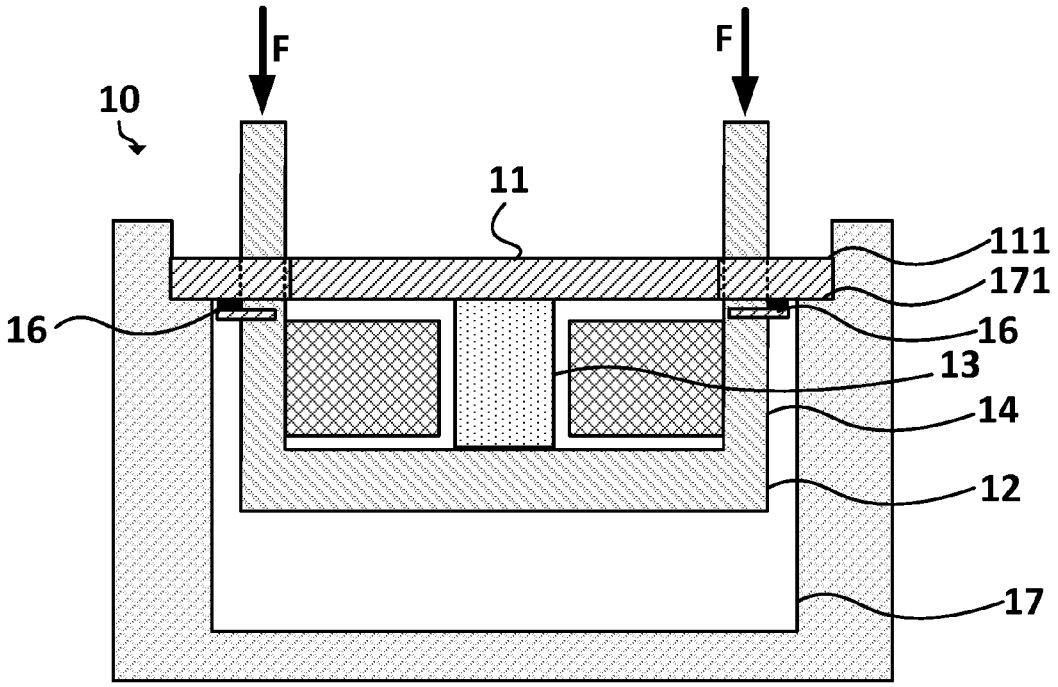
FIG. 5D is a sectional diagram illustrating a power generating device before the external force acts according to another embodiment of the invention.
Figure 5E:
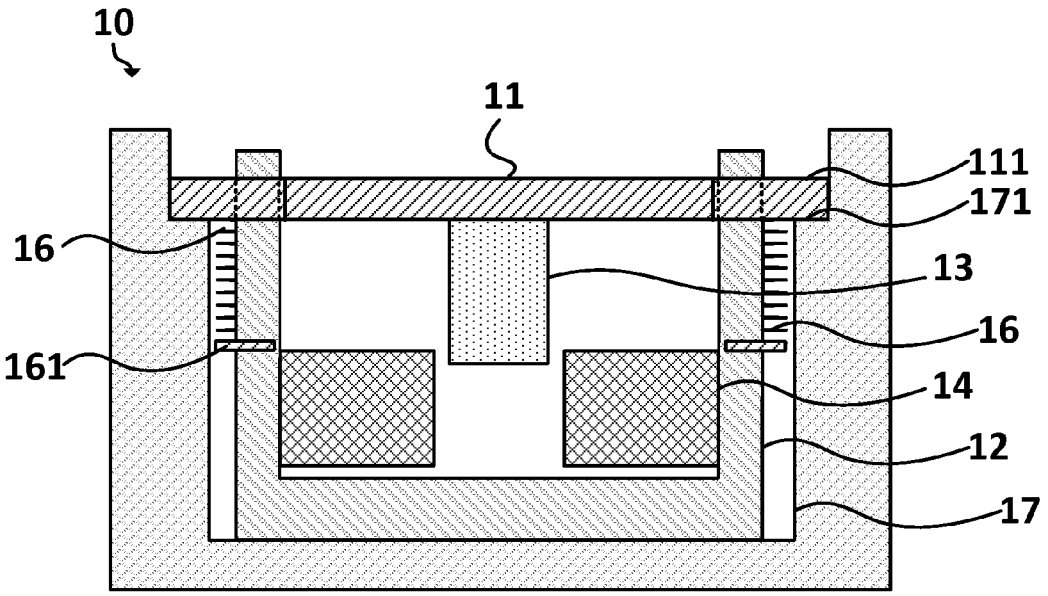
FIG. 5E is a sectional diagram illustrating a power generating device when the external force F acts according to the embodiment of the invention.

Please refer to FIG. 5D and FIG. 5E. FIG. 5D is a sectional diagram illustrating a power generating device before the external force F acts according to another embodiment of the invention. FIG. 5E is a sectional diagram illustrating a power generating device when the external force F acts according to the embodiment of the invention. As shown in the figures, the elastic component 16 can be configured between the first engagement part 111 and the second engagement part 121 to provide a recovery force against the external force F to the first casing 11. The elastic component 16 extends when the external force F acts on the second casing 12, and provides an opposite force to recover the second casing 12 to the original position when the external force F vanishes. This embodiment shown is similar to the embodiment shown in FIG. 5A and FIG. 5A except the position of the elastic component 16, so that the extending designs in the above embodiment can be used in this embodiment.

Figure 6A:
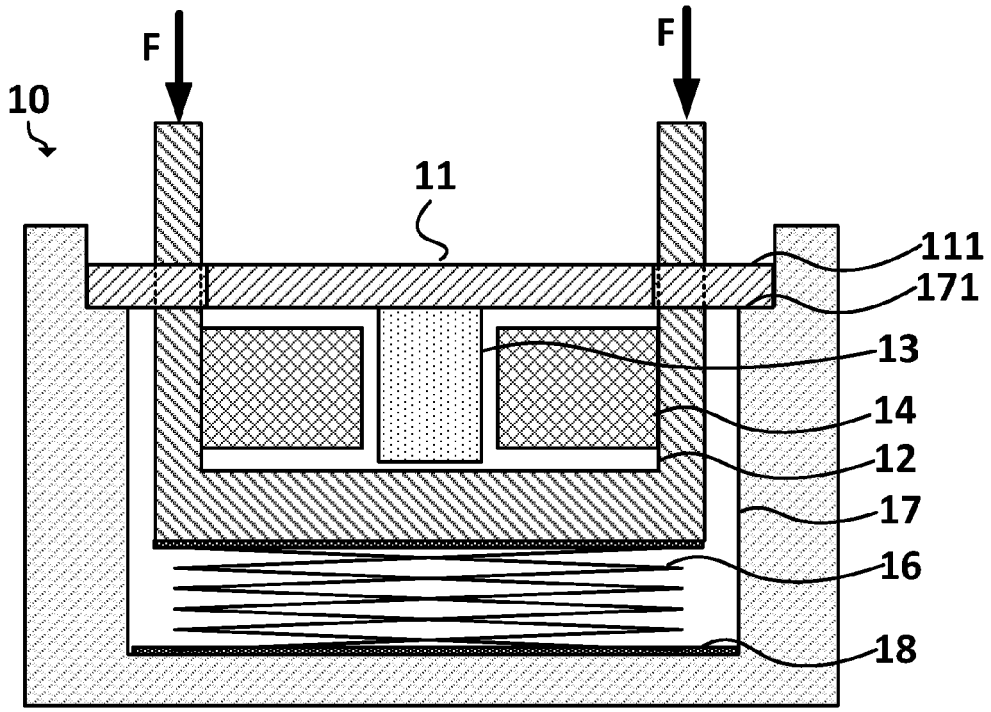
FIG. 6A is a sectional diagram illustrating a power generating device before the external force acts according to another embodiment of the invention.
Figure 6B:
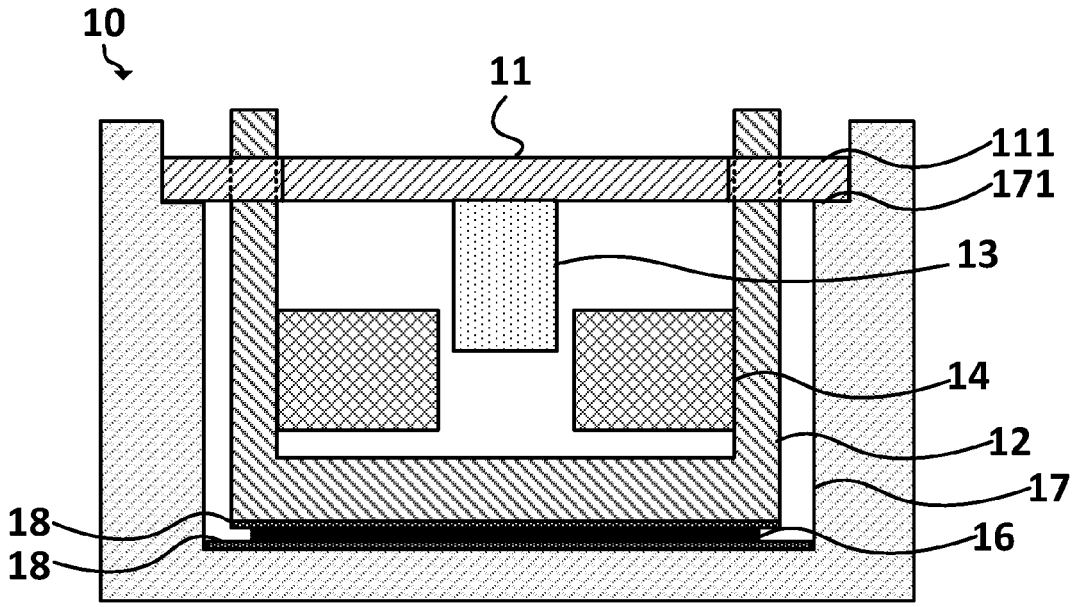
FIG. 6B is a sectional diagram illustrating a power generating device when the external force acts according to the embodiment of the invention.

According to another embodiment, a second piezoelectric module 18 can be added in the power generating device 10 shown in FIG. 5B to 5C. Please refer to FIG. 6A and FIG. 6B. FIG. 6A is a sectional diagram illustrating a power generating device before the external force F acts according to another embodiment of the invention. FIG. 6B is a sectional diagram illustrating a power generating device when the external force F acts according to the embodiment of the invention.

Figure 6C:
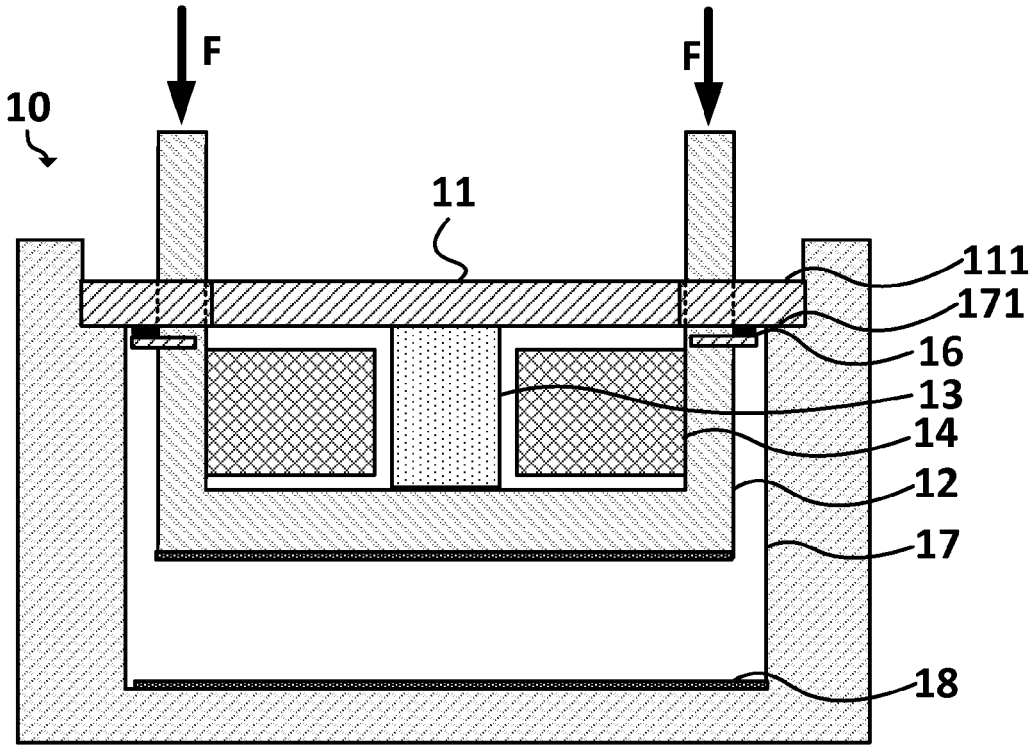
FIG. 6C is a sectional diagram illustrating a power generating device before the external force acts according to another embodiment of the invention.
Figure 6D:
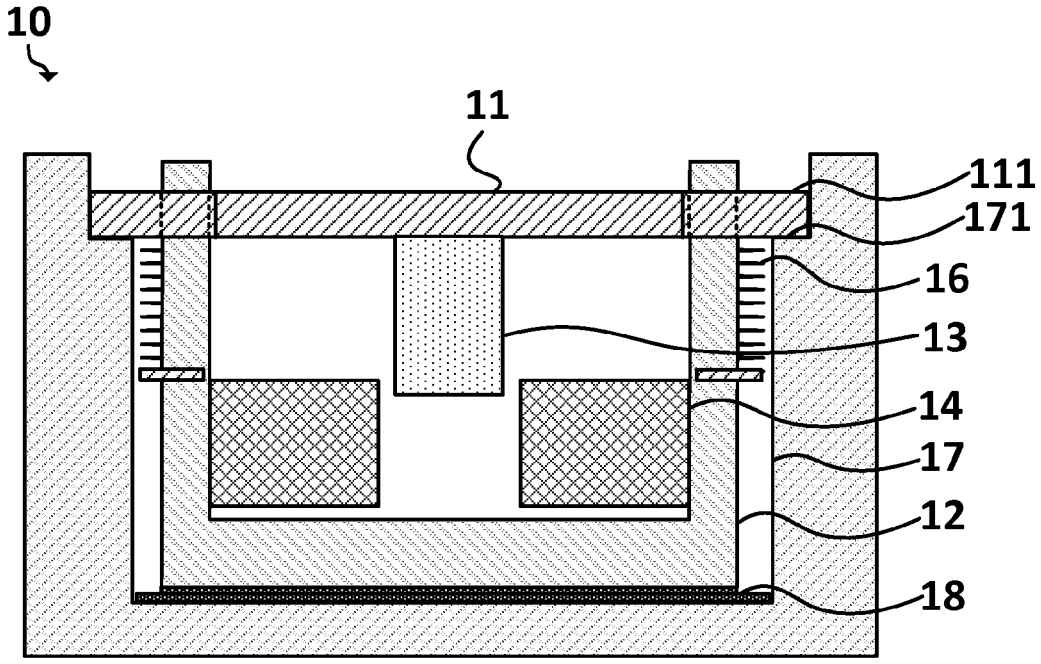
FIG. 6D is a sectional diagram illustrating a power generating device when the external force acts according to the embodiment of the invention.

As shown in the figures, the second piezoelectric module 18 is configured between the second casing 12 and the third casing 17, for absorbing the pressure between the second casing 12 and the third casing 17 to deform and generate a second charge. In detail, when the second casing 12 is forced and then presses the third casing 17, the second piezoelectric module 18 deforms by the pressure and generates the charge corresponding to the pressure. The electricity storing device 50 can be further coupled to the second piezoelectric module 18 to receive and store the inducted current and the second charge generating by the induction coil 14 and the second piezoelectric module 18. The stored electric energy stored in the electricity storing device 50 can be provided to lighting device 30 and the control device 40. If the electricity storing device 50 is omitted, the power generating device 10 can be directly connected to the lighting device 30 or connected to the lighting device 30 through a rectification component to provide the electric energy. It should be noted that the elastic component 16 can be configured between the first casing 11 and the second casing 12, as shown in FIG. 6C and FIG. 6D.

It should be noted that the first piezoelectric module 15 and the second piezoelectric module 18 in the above-mentioned embodiments deform by the external force to introduce potential differences between their two opposite surfaces and generate the first charge and the second charge corresponding to the pressure respectively. The piezoelectric module can be made of one piezoelectric material, a combination of several piezoelectric materials, or more complex structure. The followings would describe the first piezoelectric module 15 and the second piezoelectric module 18 in detail according to another embodiment.

Figure 7A:
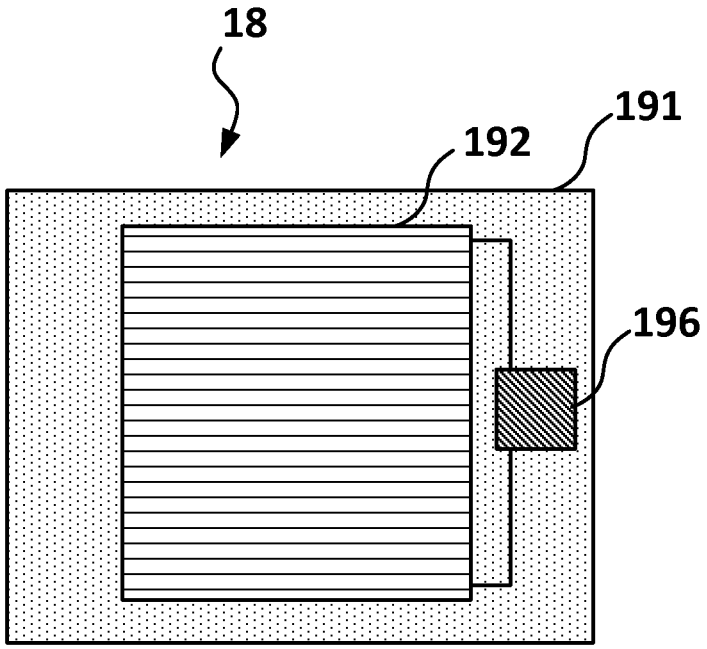
FIG. 7A is a schematic drawing illustrating the piezoelectric module of the power generating device according to another embodiment of the invention.
Figure 7B:
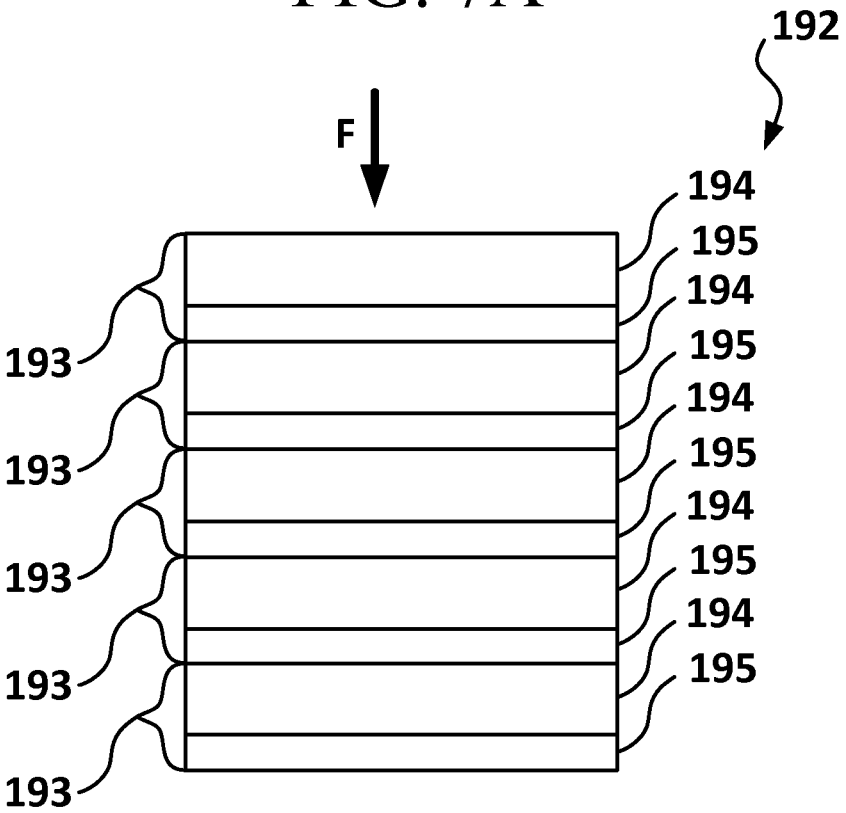
FIG. 7B is a schematic drawing illustrating the piezoelectric module of the power generating device according to another embodiment of the invention.

Please refer to FIG. 7A and FIG. 7B. FIG. 7A is a schematic drawing illustrating the piezoelectric module of the power generating device according to another embodiment of the invention. FIG. 7B is a schematic drawing illustrating the piezoelectric module of the power generating device according to another embodiment of the invention. It should be noted that the piezoelectric module is marked as the second piezoelectric module 18, and the piezoelectric module in FIG. 7B can be recognized as the first piezoelectric module 15 or the second piezoelectric module 18. In this embodiment, the first piezoelectric module 15 or the second piezoelectric module 18 includes an elastic object 191 and a piezoelectric unit set 192. The elastic object 191 has a first elastic coefficient, and the piezoelectric unit set 192 is configured in the elastic object 191 to generate a corresponding first charge or second charge. In detail, when the elastic object 191 is pressed and further presses the piezoelectric unit set 192, the piezoelectric unit set 192 generates the first charge or the second charge correspondingly. The electricity storing device 50 can be coupled to the first piezoelectric unit set 192 to receive and store the first charge or the second charge generated by the piezoelectric unit set 192. The stored electric energy in electricity storing device 50 can be provided to the lighting device 30 and the control device 40. If the electricity storing device 50 is omitted, the power generating devices 10 can be directly connected to the lighting device 30 or connected to the lighting device 30 through a rectification component to provide the electric energy.

The piezoelectric unit set 192 can be formed by a plurality of piezoelectric units 193 those are stacked and series connected to each other. Each of the piezoelectric units 193 has a second elastic coefficient and includes a piezoelectric material 194 and a metal plate 195. It should be noted that the amount of piezoelectric materials 194 and metal plates 195 included in the piezoelectric unit set 192 are not limited to that of the embodiment, but decided according to the practical requirement.

The piezoelectric unit set 192 is configured in the elastic object 191 so that the elastic object 191 fixes and protects the piezoelectric unit set 192 to prevent the piezoelectric unit set 192 from damaging or falling out.

Please refer to FIG. 7B. FIG. 7B is a schematic drawing illustrating the piezoelectric unit set 192 according to another embodiment of the invention. As shown in FIG. 7B, the piezoelectric unit set 192 is formed by series connecting a plurality of the piezoelectric units 193. Each of the piezoelectric units 193 includes a piezoelectric material 194 and a metal plate 195. The piezoelectric material 194 has a particular lattice so that the stress field and the electric field can be coupled together in the piezoelectric material 194. When the piezoelectric material 194 bears a pressure, the distances of the electric dipoles become shorter by the compression of the material. The piezoelectric material 194 generates isometric positive charges and negative charges on the opposite surfaces thereof to keep the distances of the electric dipoles, resulting in generating electric field, i.e., voltage. In practice, the piezoelectric material 194 can be made of ferroelectric crystal such as lithium niobate, tantalum niobate, potassium biphosphate, ammonium dihydrogen phosphate, and lead hydrogen phosphate, or other materials with piezoelectric effect.

In this embodiment, the piezoelectric material 194 is an output anode and the metal plate 195 is an output cathode. The piezoelectric material 194 and the metal plate 195 are stacked to each other to form the piezoelectric unit 193. The piezoelectric units 193 are series connected to each other to form the piezoelectric unit set 192. Compared to single piezoelectric unit, the piezoelectric unit set 192 including the plurality of piezoelectric units 193 can output higher voltage.

The elastic object 191 has a first elastic coefficient, and the piezoelectric unit set 192 has a second elastic coefficient. In this embodiment, the second elastic coefficient is higher than the first elastic coefficient, so that the deforming degree of the elastic object 191 would not be smaller than that of the piezoelectric unit set 192 when bearing the same external force F, and then the deformation of the piezoelectric unit set 192 would not be limited and the voltage generated by the piezoelectric unit set 192 would not be influenced. To avoid the electric leakage or short via the elastic object 191, it can be made of insulating materials. In practice, the elastic object 191 can be polymer such as silicone, butyl rubber, and silicone resin, or other materials with elasticity and insulating ability.

Please refer to FIG. 7A again. In this embodiment, the first piezoelectric module 15 or the second piezoelectric module 18 can further include a circuit 196 configured in the elastic object 191 and electrical connected the piezoelectric unit set 192. The circuit 196 can include a rectification component for rectifying or adjusting the first charges or the second charges generated by the piezoelectric unit set 192 to output a stable electric energy. Besides the rectification component, the electricity storing device 50 can be integrated in the circuit 196.

The circuit 196 is configured in the elastic object 191 so that the elastic object 191 fixes and protects the piezoelectric unit set 192 and the circuit 196 at the same time to prevent them from damaging or falling out when the external force F acts. In this embodiment, the elastic object 191 can be made of a waterproof material and cover the piezoelectric unit set 192 and the circuit 196 completely to prevent them from damage by water.

As shown in FIG. 7A, when the external force F acts on the piezoelectric unit set 192, the piezoelectric unit set 192 bears the pressure and deforms to generate electric energy by the piezoelectric effect. The circuit 196 can rectify the electric energy and then transmit it to the electricity storing device 50 or directly to the lighting device 30 for driving the lighting device 30. Therefore, the lighting device 30 is capable of lighting without an external power source to achieve the energy saving function.

As described above, various power generating devices of the invention can be applied to the lighting shoe according to the thickness, the electrical requirement, or the cost of the lighting shoe. The user steps and exerts an external force on the main body of the lighting shoe to enable the lighting device configured therein. In detail, the power generating device substantially generates electric energy by the induction coil. However, the designer adds the first piezoelectric module or the second piezoelectric module to increase the electric energy generating capacity. Accordingly, the lighting shoe needing no external power source or battery can automatically generate electric energy with the user's walking. It should be noted that the light module of the power generating device of the invention increases the identification rate in the night, and improves the traffic safety of the user.

Although the present invention has been illustrated and described with reference to the preferred embodiment thereof, it should be understood that it is in no way limited to the details of such embodiment but is capable of numerous modifications within the scope of the appended claims.

What is claimed is:

1. A lighting shoe comprising:

a main body, having a heel part;

a power generating device, configured in the heel part for bearing an external force and generating electric energy according to the external force, the power generating device comprising:

a first casing, having at least one first engagement part;

a second casing, having at least one second engagement part, the second engagement part being movably coupled to the first engagement part to form a space between the first casing and the second casing and to enable the first casing moving relatively to the second casing;

a magnetic component, fixed on the first casing and configured in the space;

an induction coil, fixed on the second casing and configured in the space, the induction coil positioned outside the contour of the magnetic component; and a first piezoelectric module, configured between the magnetic component and the second casing;

wherein, when the external force acts on the power generating device, the first casing and the second casing move relatively to each other so that the induction coil generates an induced current by sensing a magnetic flux variation, and the first piezoelectric module generates a first charge by absorbing the pressure between the magnetic component and the second casing; and a lighting device, coupled to the power generating device and having at least one LED unit, the lighting device receiving the electric energy from the power generating device and providing the electric energy to the LED unit to generate the light.

2. The lighting shoe of claim 1, further comprising:

an electricity storing device, coupled to the induction coil, the first piezoelectric module, and the lighting device for receiving the induced current and the first charge and store them as stored electric energy for the lighting device.

3. The lighting shoe of claim 1, wherein the power generating device further comprises:

an elastic component, configured between the first casing and the second casing, the first casing and the second casing moving relatively to each other and the elastic component providing a recovery force when the external force acts on the power generating device.

4. The lighting shoe of claim 1, wherein the power generating device further comprises:

a third casing, contacting the first casing and having a third engagement part for engaging the first engagement part;

wherein, the second casing and the third casing move relatively to each other when the external force acts on the power generating device.

5. The lighting shoe of claim 1, wherein the first piezoelectric module further comprises:

an elastic object, having a first elastic coefficient; and a piezoelectric unit set, for generating the first charge, the piezoelectric unit set being configured in the elastic object and formed by a plurality of piezoelectric units stacked and series connected to each other, each of the piezoelectric units having a second elastic coefficient and comprising a piezoelectric material and a metal plate;

wherein, the second elastic coefficient is larger than the first elastic coefficient.

6. A lighting shoe comprising:

a main body, having a heel part;

a power generating device, configured in the heel part for bearing an external force and generating electric energy according to the external force, the power generating device comprising:

a first casing, having at least one first engagement part;

a second casing, having at least one second engagement part, the second engagement part being movably coupled to the first engagement part to form a space between the first casing and the second casing and to enable the second casing moving relatively to the first casing;

a magnetic component, fixed on the first casing and configured in the space;

an induction coil, fixed on the second casing and configured in the space, the induction coil positioned outside the contour of the magnetic component;

a third casing, having a third engagement part for engaging the first engagement part and containing at least a part of the second casing to enable the second casing moving relatively to the third casing; and a second piezoelectric module, configured between the second casing and the third casing;

wherein, when the external force acts on the power generating device, the first casing and the second casing move relatively to each other so that the induction coil generates an induced current by sensing a magnetic flux variation, and the second piezoelectric module generates a second charge by absorbing the pressure between the second casing and the third casing; and a lighting device, coupled to the power generating device and having at least one LED unit, the lighting device receiving the electric energy from the power generating device and providing the electric energy to the LED unit to generate the light.

7. The lighting shoe of claim 6, further comprising:

an electricity storing device, coupled to the induction coil, the second piezoelectric module, and the lighting device for receiving the induced current and the second charge and store them as stored electric energy for the lighting device.

8. The lighting shoe of claim 6, further comprising:

a first piezoelectric module, configured between the magnetic component and the second casing;

wherein, when the external force acts on the power generating device, the first casing and the second casing move relatively to each other, and the first piezoelectric module generates a first charge by absorbing the pressure between the magnetic component and the second casing.

9. The lighting shoe of claim 6, wherein the power generating device comprises:

an elastic component, configured between the first casing and the second casing, the first casing and the second casing moving relatively to each other and the elastic component providing a recovery force when the external force acts on the power generating device.

10. The lighting shoe of claim 6, wherein the power generating device comprises:

an elastic component, configured between the second casing and the third casing, the second casing and the third casing moving relatively to each other and the elastic component providing a recovery force when the external force acts on the power generating device.

11. The lighting shoe of claim 6, wherein the second piezoelectric module further comprises:

an elastic object, having a first elastic coefficient; and a piezoelectric unit set, for generating the second charge, the piezoelectric unit set being configured in the elastic object and formed by a plurality of piezoelectric units stacked and series connected to each other, each of the piezoelectric units having a second elastic coefficient and comprising a piezoelectric material and a metal plate;

wherein, the second elastic coefficient is larger than the first elastic coefficient.

12. A lighting shoe comprising:

a power generating device, for bearing an external force and generating electric energy according to the external force, the power generating device comprising:

a first casing, having at least one first engagement part;

a second casing, having at least one second engagement part, the second engagement part being movably coupled to the first engagement part to form a space between the first casing and the second casing and to enable the first casing moving relatively to the second casing;

a magnetic component, fixed on the first casing and configured in the space;

an induction coil, fixed on the second casing and configured in the space, the induction coil positioned outside the contour of the magnetic component; and wherein, when the external force acts on the power generating device, the first casing and the second casing move relatively to each other so that the induction coil generates an induced current by sensing a magnetic flux variation; and a lighting device, coupled to the power generating device and having at least one LED unit, the lighting device receiving the electric energy from the power generating device and providing the electric energy to the LED unit to generating the light.

13. The lighting shoe of claim 12, the power generating device further comprising:

a first piezoelectric module configured between the magnetic component and the second casing, when the external force acts on the power generating device the first piezoelectric module generates a first charge by absorbing the pressure between the magnetic component and the second casing.

14. The lighting shoe of claim 12, the power generating device further comprising:

a third casing, having a third engagement part for engaging the first engagement part; and an elastic component, configured between the second casing and the third casing, the second casing and the third casing moving relatively to each other and the elastic component providing a recovery force when the external force acts on the power generating device.

15. The lighting shoe of claim 14, the power generating device further comprising:

a second piezoelectric module, configured between the second casing and the third casing, when the external force acts on the power generating device the second piezoelectric module generates a second charge by absorbing the pressure between the second casing and the third casing.

* * * * *